US005723947A

United States Patent [19]

Popov et al.

[11] Patent Number: 5,723,947

[45] Date of Patent: Mar. 3, 1998

[54] ELECTRODELESS INDUCTIVELY-COUPLED FLUORESCENT LAMP WITH IMPROVED CAVITY AND TUBULATION

[75] Inventors: Oleg Popov, Needham; Jakob Maya, Brookline; Koichi Kobayashi, Needham; Edward K. Shapiro, Levington, all of Mass.

[73] Assignee: Matsushita Electric Works Research & Development Laboratories Inc., Woborn, Mass.

[21] Appl. No.: 772,139

[22] Filed: Dec. 20, 1996

[51] Int. Cl.[6] ..... H01H 65/04; H01H 65/00

[52] U.S. Cl. ..... 313/634; 313/234; 313/607; 315/248

[58] Field of Search ..... 313/18, 30, 42, 313/46, 607, 234, 634, 493; 315/248, 112, 85

[56] References Cited

U.S. PATENT DOCUMENTS

| | | | |
|---|---|---|---|
| 2,030,957 | 2/1936 | Bethenod te al. | 176/122 |
| 4,010,400 | 3/1977 | Hollister | 315/248 |
| 4,568,859 | 2/1986 | Houkes et al. | 315/248 |
| 4,622,495 | 11/1986 | Smeelen | 315/248 |
| 4,704,562 | 11/1987 | Postma et al. | 315/248 |
| 4,710,678 | 12/1987 | Houkes et al. | 315/39 |
| 4,727,295 | 2/1988 | Postma et al. | 315/248 |
| 5,325,018 | 6/1994 | El-Hamamsy | 315/85 |
| 5,343,126 | 8/1994 | Farrall et al. | 315/248 |
| 5,355,054 | 10/1994 | Van Lierop et al. | 315/112 |
| 5,412,280 | 5/1995 | Scott et al. | 313/573 |
| 5,412,288 | 5/1995 | Borowiec et al. | 315/248 |
| 5,412,289 | 5/1995 | Thomas et al. | 315/248 |
| 5,434,482 | 7/1995 | Borowiec et al. | 315/248 |
| 5,461,284 | 10/1995 | Roberts et al. | 315/57 |
| 5,465,028 | 11/1995 | Antonis et al. | 315/248 |
| 5,500,567 | 3/1996 | Wilson et al. | 313/490 |
| 5,559,392 | 9/1996 | Cocoma et al. | 313/490 |
| 5,563,474 | 10/1996 | Wessels et al. | 315/248 |
| 5,621,266 | 4/1997 | Popov et al. | 313/46 |

*Primary Examiner*—Nimeskumar Patel

[57] ABSTRACT

An electrodeless inductively-coupled fluorescent lamp which operates at radio frequency comprising a bulbous envelope (1) filled with rare gas and metal vapor. A reentrant cavity (4) and an induction coil (6) are disposed in the cavity (4). The inner walls of the envelope (1) and the cavity (4) have a protective coating (3) and a phosphor coating (2). A metal Faraday cylinder (12) welded to the lamp base (13) is disposed between the cavity (4) and the coil (6) to reduce capacitive RF voltage between the coil and the plasma to improve lamp maintenance and remove heat. A tubulation (16) is disposed on the lamp axis to evacuate the envelope (1). The proximal end of the tubulation (16) has an expansion (20) with the volume (23) where the initial capacitive discharge is ignited. The RF coil voltage needed for the ignition of the capacitive discharge in the expansion area (23) is substantially lower than that needed for the ignition of the capacitive discharge in the area (14) along the inner cavity walls (4) to decrease the lamp starting voltage. In one of the embodiments of the present invention the expansion is conically shaped and in another it is cylindrically shaped and is used to generate the inductive plasma to increase the light generation in the top part of the bulb (28) and improve light output through the bulb top surface (27).

13 Claims, 2 Drawing Sheets

ELECTRODELESS INDUCTIVELY-COUPLED FLUORESCENT LAMP WITH IMPROVED CAVITY AND TUBULATION

BACKGROUND OF THE INVENTION

Electrodeless RF inductively-coupled fluorescent lamps (ICFLs) have been applied recently for indoor and outdoor illumination. They employ an inductively-coupled plasma for the generation of the visible and UV light and have lifetimes longer than conventional compact fluorescent lamps which employ hot cathodes.

In an electrodeless ICFL described in the prior art, U.S. Pat. No. 5,621,266 to Popov et al. (owned by the same assignee as the present application), an inductively-coupled plasma is generated in a bulb filled with the mixture of rare gas and metal vapor (mercury, sodium and/or cadmium). The plasma is maintained by the azimuthal RF electric field, $E_{ind}$, which is induced in the bulb volume by an induction coil inserted in the reentrant cavity. A 1–2 mm thick metal (aluminum) cylinder with a few longitudinal slits is inserted between the coil and the cavity and works as a Faraday cage. The cylinder shields the coil from the plasma and reduces the capacitive coupling between the plasma and the coil. This, in turn, reduces the RF voltage in the sheath which is formed between the plasma and the cavity walls. The reduction of the RF voltage in the sheath is necessary to reduce the bombardment of the cavity wall coating with plasma ions leading to improved lamp maintenance. The metal cylinder is welded to an aluminum metal lamp base to remove heat from the coil and the cavity and transfer it to the lamp base. A tubulation is attached to the top part of the cavity along the cavity axis and is used for gas evacuation and location of the mercury amalgam.

One of the important parameters of the inductively-coupled fluorescent lamp is the starting voltage, $V_{st}$. This is a minimum RF voltage across the induction coil which is required to ignite and maintain an inductive discharge in the lamp. The starting voltage could be either a coil RF voltage which is required to ignite the capacitive discharge, $V_{st}=V_{cap}$, or the coil RF voltage which is needed for the transition of the capacitive discharge to the inductive discharge, $V_{st}=V_{tr}$. It is desirable, from the RF driver point of view, to have $V_{st}$ as low as possible.

The ignition of the capacitive discharge occurs when an RF electric field, $E_{cap}$, induced in the lamp volume via the capacitive coupling, reaches the value needed to ignite and maintain a capacitive discharge in the lamp area. The area is located at the cavity walls near the upper coil's turns which have highest RF potential. The value of $E_{cap}$ is determined by the magnitude of the RF voltage across the coil, $V_{coil}$, and by the value of the capacitance between the coil turns and the area mentioned above. The shorter the distance between the turns and the area, the larger the capacitance. This leads to a smaller coil RF voltage, $V_{cap}$, needed to induce the ignition RF electric field, $E_{cap}$.

In the absence of the Faraday shield, the capacitance is large so a relatively low RF voltage across the coil, $V_{cap}$, induces the required RF electric field, $E_{cap}$, needed for the ignition of the capacitive discharge in the area. The insertion of the grounded Faraday cylinder between the coil and the reentrant cavity walls causes shielding of the lamp volume from the coil, and substantially reduces the capacitive coupling between the coil turns and the lamp volume. Also, in order to avoid the direct heating by the plasma radiation, the coil is inserted "deep" inside the Faraday cylinder and far away from the top part of the cavity walls. As a result, the capacitance between the coil upper turns and the lamp volume (where capacitive discharge is ignited) is very small. Therefore, in order to ignite the capacitive discharge in the area mentioned above, a very high RF voltage, $V_{cap}$, has to be applied across the coil. This voltage can be even higher than the coil voltage, $V_{tr}$, needed for the transition of the capacitive discharge to the inductive one. Thus, starting of the lamp is determined by the magnitude of the capacitive discharge ignition voltage, $V_{cap}$.

One of the solutions to reduce the capacitive ignition voltage, $V_{cap}$, (and, hence, the lamp starting voltage) was suggested in prior art, U.S. Pat. No. 5,465,028. Patentees used a lower RF frequency of 2.65 MHz and employed a hollow ferrite cylinder located in the center of the reentrant cavity. To reduce lamp capacitive discharge ignition voltage, a bifilar coil was utilized which consisted of two windings wound in a manner that led to an increase of the capacitively-coupled electric field in the lamp without increasing the RF voltage across the coil. However, the upper coil turns have a substantially high RF potential with respect to the grounded plasma. This leads to the formation of the dc voltage across the sheath between the plasma and the cavity walls, $V_{dc}$, which accelerates plasma ions in the sheath towards the cavity walls and causes phosphor coating degradation.

The other disadvantage of the prior art is a nonuniform light distribution from various parts of the bulb. Indeed, the radiation from the ICFL utilizing the reentrant cavity and the solenoidal inductive coil comes from the inductive discharge plasma which is generated along the inner cavity walls. This plasma has a shape of a torus or cylinder dependent on the ratio of the coil diameter to its length and has a length close to the height of the coil. The area below and above the induction coil is free from the inductive discharge and filled with a low density, low electron temperature plasma diffused from the inductive discharge zone. In particular, the volume between the top surface of the reentrant cavity and the bulb top surface has no inductive discharge plasma and, therefore, has a very low light radiation. As a result, the light output through the top bulb surface is lower than that from the side walls of the bulb.

SUMMARY OF THE INVENTION

An object of the present invention is to provide an RF electrodeless, inductively-coupled fluorescent light source that can be substituted for an incandescent light source, a high pressure mercury light source, a metal halide light source or a compact fluorescent light source.

Another object of the present invention is to provide a tubulation with a size and shape such that the ignition of the capacitive discharge takes place in a top part of the tubulation, while the ignition and the maintaining of the inductive discharge takes place in the lamp volume along the cavity inner walls.

An additional object of the present invention is to reduce the capacitive discharge ignition voltage to a value lower than the transition voltage.

A further object of the present invention is to design the reentrant cavity, the Faraday shield, the induction coil, and the tubulation so the capacitive ignition voltage is below the transition voltage while the induction coil is operable and the lamp light output is not reduced.

Another object of the present invention is to design the upper part of the tubulation with a sufficient wall diameter so an induction discharge plasma can be ignited there, and thereby light output through the surface of the bulb top part is increased.

Yet another object of the present invention is to design the upper part of the tubulation so the inductive discharge is not ignited below a certain zone as to prevent an inductive discharge in the rest of the tubulation.

DESCRIPTION OF THE PREFERRED EMBODIMENTS

Figure 1:
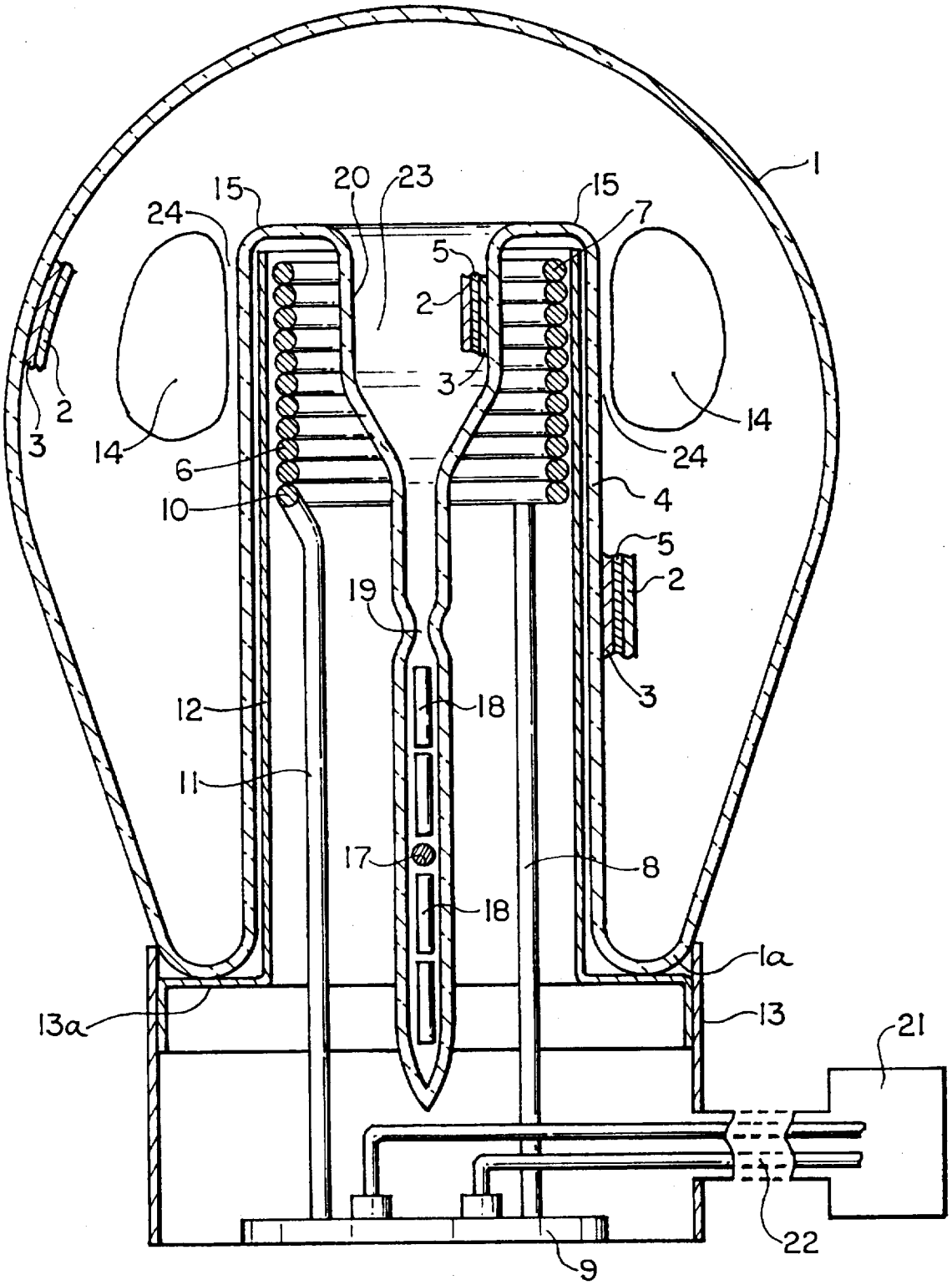
FIG. 1 is a cross-sectional view of one embodiment of the present invention and shows an electrodeless inductively-coupled fluorescent lamp with an induction coil, a Faraday cylinder between the coil and the cavity, a lamp base with the matching network, and an axial tubulation having as its top part an expansion of a cylindrical shape.

Referring now to one embodiment of the present invention (FIG. 1), a bulbous envelope 1 made from the glass is shown with a phosphor coating 2. A protective coating 3 formed of silica, alumina, or the like, is disposed between the glass and the phosphor coating. The envelope 1 has a reentrant cavity 4 disposed on the bulb axis and sealed to the bottom 1*a* of the envelope 1. The inner walls of the cavity 4 have the phosphor coating 2, the protective coating 3, and a reflective coating 5 between the protective coating 3 and the phosphor coating 2.

An induction coil 6 having an inductance of 1–4 μH and between 5–20 turns is disposed in the cavity 4. The top turn 7 of the coil 6 is connected via lead-in wire 8 to a hot RF end of the matching network 9. The bottom 10 of the coil 6 is connected via the lead-in wire 11 to a grounded end of the matching network 9.

A cylinder 12 made from a light-conductive material having high thermal conductivity (Al or Cu, for example) is disposed between the cavity 4 and the coil 6. The cylinder has several longitudinal cuts with a width of 1–3 mm each and is welded to a cylindrical flange 13*a*. A flange 13*a* is welded to a support base 13 which, in turn, is welded to the fixture. The flange 13*a* and the support frame 13 form a lamp base.

The cylinder 12 works as a Faraday shield to reduce capacitive coupling between the coil turns and a discharge plasma 14 formed near the cavity walls 4. To further reduce the capacitive coupling between the coil 6 and the plasma 14, the coil is removed 10–15 mm away from the cavity's top surface 15 by the insertion of the coil 6 inside of the cylinder 12 so the distance between the top coil turns and the cylinder upper edge is 5–8 mm. The cylinder 12 also works as a means to remove heat from the coil 6 and the cavity wall and to redirect heat to the fixture via the lamp base 13.

A tubulation 16 is disposed on the cavity axis. The distal end of the tubulation has a small diameter of 4–6 mm and has an amalgam 17 positioned at 10–20 mm inside of the cavity. A few glass rods 18 are inserted inside of the cavity from both sides of the amalgam 17. A restriction 19 is made in the center of the tubulation 16 to prevent rods from entering the upper part of the tubulation 16. The upper part of the tubulation has an expansion 20 at the proximal end.

In the embodiment depicted in FIG. 1, the expansion 20 has a cylindrical shape with a diameter from 10 to 30 mm dependent on coil and cavity diameters. The length of the expansion 20 is from 10 to 40 mm dependent on the coil length and structure.

Figure 2:
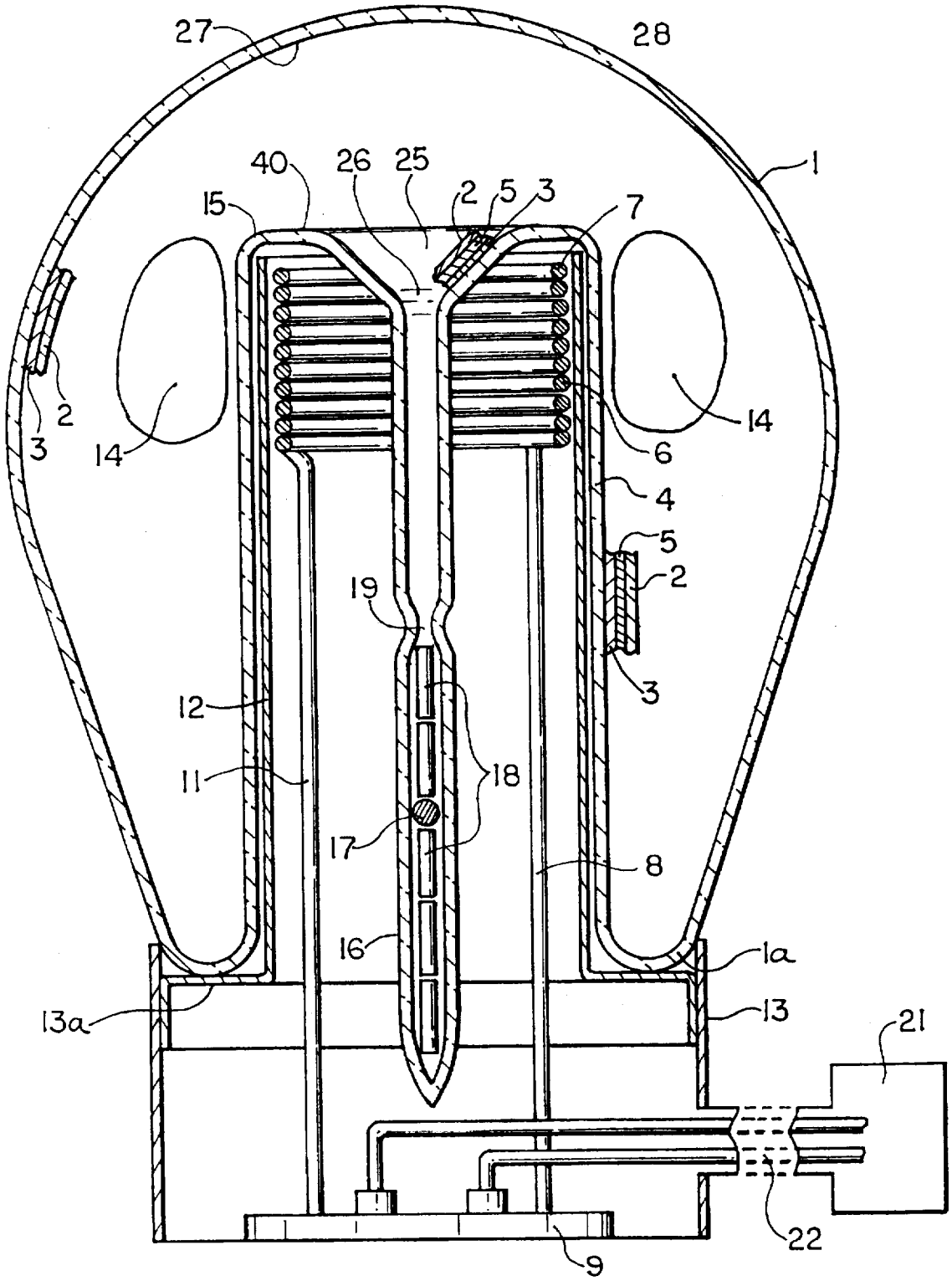
FIG. 2 is a cross-sectional view of a second embodiment of the present invention and shows an electrodeless inductively-coupled fluorescent lamp having an induction coil, a reentrant cavity, a Faraday cylinder, a lamp base, and an axially-located tubulation with a conical shape expansion as its top part.

In the second embodiment of the present invention, as depicted in FIG. 2, the expansion 40 is made as a top part of a tubulation 16 and has a conical shape with a wide opening 25 in the top and a small opening in the bottom 26. The diameter of the opening 25 is between 10 and 40 mm dependent upon the coil 6 and the diameter of the cavity 4. The diameter of the tubulation 16 is typically between 4 and 6 mm. The length of the expansion 20 in the embodiment 2 is between 5 and 40 mm dependent on the coil length, structure, and position along the cavity walls.

The diameter and length of the expansion in both embodiments are large enough to provide the capacitive discharge ignition voltage, $V_{cap}$, lower than the transition voltage $V_{tr}$. On the other hand, the diameter of the expansion 20 in the first embodiment should not be large to prevent the ignition of the inductive discharge in the expansion volume 23. Indeed, the increase of the expansion diameter leads to the decrease of the induced electric field, $E_{ind}$, needed to maintain an inductively-coupled RF discharge in the expansion volume 23.

We observed the plasma generated in the cylindrical expansion 20 has radiation spectra and color temperature different from those of the "main" induction plasma 14 maintained along the cavity inner walls. This is because the expansion plasma 23 of the first embodiment is typical for discharges ignited in volumes of small radii and having a high inductively-induced electric field, $E_{ind}$.

Furthermore, because of high electron temperature in the expansion plasma 23, the energy of ions bombarding the walls of the expansion 20 is much higher than the energy of ions in the main plasma 14. As a result, the phosphor coating on the expansion walls 20 deteriorates much faster than the phosphor coating on the lamp bulb walls 2 and cavity walls 4. In the second embodiment of the present invention, the diameter of the top opening 25 of the conical expansion 40 is large so the inductive RF electric field, $E_{ind}$, and the electron temperature are low and the radiation of the plasma 25 has the same spectra as the "main" plasma 14.

Table 1 shows the coil voltage needed for the ignition capacitive discharge, $V_{cap}$, and the coil voltage needed for the transition from the capacitive discharge to the inductive one, $V_{tr}$. The measurements were made in electrodeless RF fluorescent lamps of the prior art (the diameter of the top part of the tubulation is 6 mm), and in the RF lamps of the present invention (the diameter of the top part of the tubulation is 15 mm). Starting voltage is chosen as the highest voltage between $V_{cap}$ and $V_{tr}$.

The effect of the diameter of the expansion 20 of the embodiment 1 on magnitudes of $V_{cap}$ and $V_{tr}$ is shown in Table 1. The measurements of the capacitive and transition voltages were made in Krypton (0.3 Torr) filled ICFL and at ambient temperature of 26° C. All lamps had the aluminum Faraday cylinder welded to the lamp base as it is shown in FIGS. 1 and 2. The coil was inside the aluminum cylinder at a distance of 8–10 mm from the cylinder edge. The diameter of the expansion 20 was 15 mm. The starting voltage shown in Table 1 is the highest voltage between $V_{cap}$ and $V_{tr}$.

TABLE I

STARTING VOLTAGE OF ELECTRODELESS FLUORESCENT LAMPS HAVING SMALL AND LARGE DIAMETER OF TOP PART OF TUBULATION
$D_b$ = 105 mm; $D_{cav}$ = 38 mm
Kr 0.3 TORR $T_{amb}$ = 25° C.
Fully Packaged Lamps
With Slotted Aluminum Cylinder
OD = 36 mm ID = 34 mm
Squeezed Coil
$L_{coil}$ = 1.7 μH $D_{coil}$ = 33 mm
Lamps were "OFF" for 20 Hrs

| LAMP # | $D_{top}$ mm | $V_{cap}$ o-p | $V_{tr}$ o-p | $V_{st}$ o-p |
|---|---|---|---|---|
| 1–6 | 6 | 570 | 389 | 570 |
| 2–6 | 6 | 587 | 414 | 587 |
| 3–6 | 6 | 598 | 425 | 598 |
| 1–15 | 15 | 382 | 417 | 417 |
| 2–15 | 15 | 353 | 412 | 412 |

It can be seen from Table 1 that in ICFLs having a small tubulation diameter of 6 mm the starting voltage is the capacitive discharge ignition voltage, $V_{cap}$, and is ≅170–180 V higher than the transition voltage, $V_{tr}$. The increase of the diameter of the top part of the tubulation from 6 to 15 mm results in the decrease of $V_{cap}$ from ≅570 V–600 V to ≅350–380 V, or roughly equal to or below $V_{tr}$. As a result, the lamp starting voltage is in fact the transition voltage, $V_{tr}$, and decreases from ≅570–600 V to ≅412–417 V.

The coil was positioned 8–10 mm below the edge of the Faraday shield and was "hidden" not only from the discharge zone 14 but also from the top surface 15 of the cavity walls. Such a position of the coil turns substantially reduces the capacitive coupling between the coil and plasma adjacent to the cavity top walls 15 and reduces degradation of phosphor coating on these walls. In the U.S. Pat. No. 5,621,266 mentioned above, the top turns of the coil were flush with the Faraday cylinder top edge that increases capacitive coupling of the coil with the plasma near the cavity top walls and causes intense ion bombardment of these walls.

The operation of the lamp is as follows (FIG. 1). An RF driver 21 supplies the lamp matching network 9 with the RF voltage via the shielded RF cable 22. The RF voltage from the tuned matching network 9 is delivered to the coil 6 via the lead-in wires 8 and 11. The capacitively-coupled RF electric field, $E_{cap}$, needed for the ignition of the capacitive discharge is induced in the area 23 inside the expansion 20 of the lamp tubulation. The magnitude of $E_{cap}$ is determined by the distance between the coil turns and the expansion walls and by the diameter of the expansion: the smaller the distance and the larger the expansion diameter, the lower is the RF electric field, $E_{cap}$, required for the ignition of the capacitive discharge in the expansion volume 23.

As coil RF voltage and RF power grow further, the plasma generated in the expansion area 23 expands and diffuses to the area near the cavity walls 15 and to the area 14. The presence of plasma in areas 14 and 15 substantially reduces the ignition voltage of a capacitively-coupled RF discharge in those areas even though they are shielded from the coil with the Faraday cylinder.

The RF coil current, $I_{coil}$, generates in the area 14 an axial RF magnetic field which in turn induces in the same area 14 an azimuthal "inductive" electric field, $E_{ind}$. (Note, the Faraday cylinder does not interfere with the generation of $E_{ind}$.) When the plasma density, $N_c$, and the electric field, $E_{ind}$, in the area 14 reach certain magnitudes, an inductively-coupled RF discharge is established in the area 14. This discharge is characterized with high plasma density, $N_c$, low RF voltage across the coil, and low RF voltage across the sheath 24 formed between the plasma 14 and the cavity walls 4.

The inductive discharge is not ignited in the expansion 23 of the embodiment 1 because the electric field, $E_{ind}$, needed to maintain the inductively-coupled discharge in the area 23 is much higher than in the area 14 due to the small diameter of the expansion 20. Also, the plasma in the area 23 has poor power coupling with the induction coil 3 due to the large ratio of the coil diameter to the expansion 20 diameter. Indeed, the coil diameter is closer to the diameter of the discharge 14 than to the diameter of the plasma 23. As a result, in an ICFL consuming 40–150 W of RF power, the inductively-coupled RF discharge is maintained in the area 14 and not in the area 23. Of course, the increase of the RF power is accompanied with the increase of the magnetic flux and, hence, inductive electric field in the expansion, $E_{ind}$, that causes eventually the ignition of the inductively-coupled RF discharge in the expansion 23.

To provide the better coupling between the coil 6 and the plasma 14 than between the coil 6 and the expansion plasma 23, the ratio of the diameter of the coil 6 to the diameter of the plasma 14 (which is close to the diameter of the cavity 4) should be much larger than the ratio of the diameter of the expansion 20 to the diameter of the coil 6. In the preferred embodiment 1 of the present invention the cavity diameter is 38 mm (the diameter of the plasma 14 is ≅8 mm larger). The coil diameter is 33 mm, and the expansion walls diameter is 15 mm (the expansion plasma diameter is ≅10 mm). The square of diameters ratios is the coupling coefficient, k:

$$k_{14}=(D_{coil}/D_{14})^2=0.51>>k_{23}=(D_{23}/D_{coil})^2=0.091 \quad (1)$$

It is seen the coupling coefficient, $k_{14}$, for the plasma 14 is 5 times larger than $k_{23}$ for the plasma in the expansion area 23.

In the second embodiment, FIG. 2, at normal lamp operation the inductively-coupled discharge should be ignited and maintained only in the upper part 25 of the expansion 20 where the diameter is large enough so the minimum electric field needed to maintain an inductively-coupled discharge in this zone is equal to (or lower than) an inductively-coupled electric field, $E_{ind}$, induced by the magnetic flux. The plasma generated in this discharge diffuses to the upper walls 27 of the bulb envelope 1 that leads to the increase of the light output from the top part of the bulb volume 28 and to the increase of the total radiation through the bulb surface. At the same time, without the further increase of the RF power the inductive discharge cannot be expanded in those parts of the expansion 40 which have smaller wall diameter.

It is apparent that modifications and changes can be made within the spirit and scope of the present invention, but it is our intention, however, only to be limited by the scope of the appended claims.

As our invention we claim:

1. An electrodeless ICF lamp comprising:

a lamp envelope, said envelope having a reentrant cavity disposed therein and containing a fill of a rare gas and an amalgam of a vaporizable metal;

a phosphor coating on the inside of said envelope for generation of visible light;

a tubulation along a longitudinal axis of the envelope, said tubulation having a proximal and a distal end, said distal end being used for exhaustion of the envelope and for amalgam location, said proximal end being attached to said reentrant cavity, the diameter of said tubulation being greater at said proximal end than at said distal end to form an expansion area;

a lamp base, said base adapted to be attached to a fixture;

a cylinder formed to act as a Faraday cage of an electrically and thermally conductive metal disposed inside said reentrant cavity, said cylinder being welded to the base;

an induction coil and an RF generating means to generate a plasma within said envelope disposed in said cylinder.

2. The lamp according to claim 1 wherein said expansion has a cylindrical shape and diameter larger than that of the tubulation.

3. The lamp according to claim 2 wherein at normal lamp operation the inductive discharge is maintained in the volume within the envelope adjacent to the inner cavity walls but not in said cylindrical expansion of said tubulation.

4. The lamp according to claim 1 wherein the expansion has a conical shape.

5. The lamp according to claim 4 wherein the inductive discharge maintained in the proximal end of said conically-shaped expansion is not maintained in the rest of the expansion area nor in the rest of the tubulation.

6. The lamp according to claim 1 wherein the square of the ratio of the coil diameter to the cavity wall diameter is several times (2–10) larger than the sequence of the ratio of the expansion diameter to the coil diameter.

7. The lamp according to claim 1 wherein said coil is inserted in said cylinder so the distance between the upper coil turn and the cylinder top edge is 3–50 mm.

8. The lamp according to claim 1 wherein the distance between said coil upper turns and the cavity top surface is higher than 5 mm.

9. The lamp according to claim 1 wherein said expansion area has a phosphor coating.

10. The lamp according to claim 1 wherein said expansion area has a protective coating.

11. The lamp according to claim 1 wherein said expansion area has a reflective coating.

12. The lamp according to claim 1 wherein the capacitive discharge is ignited initially in said expansion area.

13. The lamp according to claim 1 wherein said capacitive discharge ignition voltage is lower than the discharge transition voltage.

* * * * *